US006168683B1

(12) United States Patent
Cesna

(10) Patent No.: US 6,168,683 B1
(45) Date of Patent: Jan. 2, 2001

(54) APPARATUS AND METHOD FOR THE FACE-UP SURFACE TREATMENT OF WAFERS

(75) Inventor: Joseph V. Cesna, Niles, IL (US)

(73) Assignee: Speedfam-IPEC Corporation, Chandler, AZ (US)

( * ) Notice: Under 35 U.S.C. 154(b), the term of this patent shall be extended for 0 days.

(21) Appl. No.: 09/028,791

(22) Filed: Feb. 24, 1998

(51) Int. Cl.[7] ..... C23F 1/02
(52) U.S. Cl. ..... 156/345; 451/285; 451/287
(58) Field of Search ..... 156/345; 451/285, 451/287; 438/692

(56) References Cited

U.S. PATENT DOCUMENTS

| | | | | |
|---|---|---|---|---|
| 4,239,567 | | 12/1980 | Winings | 156/154 |
| 4,343,112 | | 8/1982 | Jarrett | 51/131.3 |
| 5,035,087 | | 7/1991 | Nishiguchi et al. | 51/131.1 |
| 5,069,002 | | 12/1991 | Sandhu et al. | 51/165 |
| 5,121,572 | | 6/1992 | Hilscher | 51/111 |
| 5,329,732 | | 7/1994 | Karlsrud et al. | 51/131.5 |
| 5,340,370 | * | 8/1994 | Cadien et al. | 51/308 |
| 5,377,451 | | 1/1995 | Leoni et al. | 451/287 |
| 5,498,196 | | 3/1996 | Karlsrud et al. | 451/11 |
| 5,498,199 | | 3/1996 | Karlsrud et al. | 451/289 |
| 5,653,622 | | 8/1997 | Drill et al. | 451/5 |
| 5,707,274 | * | 1/1998 | Kim et al. | 451/285 |
| 5,899,801 | * | 5/1999 | Tolles et al. | 451/288 |

FOREIGN PATENT DOCUMENTS

| | | |
|---|---|---|
| 0959873 | 6/1964 | (GB) . |
| 1377837 | 12/1974 | (GB) . |
| 2161406 | 1/1986 | (GB) . |
| 2324750 | 11/1998 | (GB) . |
| 58-223561 | 12/1983 | (JP) . |

OTHER PUBLICATIONS

British Search Report Under Section 17, Patents Act 1977.

* cited by examiner

*Primary Examiner*—Randy Gulakowski
*Assistant Examiner*—Shamim Ahmed
(74) *Attorney, Agent, or Firm*—Fitch, Even, Tabin & Flannery

(57) ABSTRACT

A polishing apparatus for semiconductor wafers includes an index table with multiple wafer positions, with different surface treatment arrangements for each position. With each index motion of the table, the table is sequentially loaded and unloaded while wafers carried at the remaining stations of the index table are moved for a subsequent surface treatment step. Progress of the surface treatment at each position is monitored and, optionally, subsequent surface treatment steps may be modified to achieve a desired final condition of the substrate being processed.

28 Claims, 8 Drawing Sheets

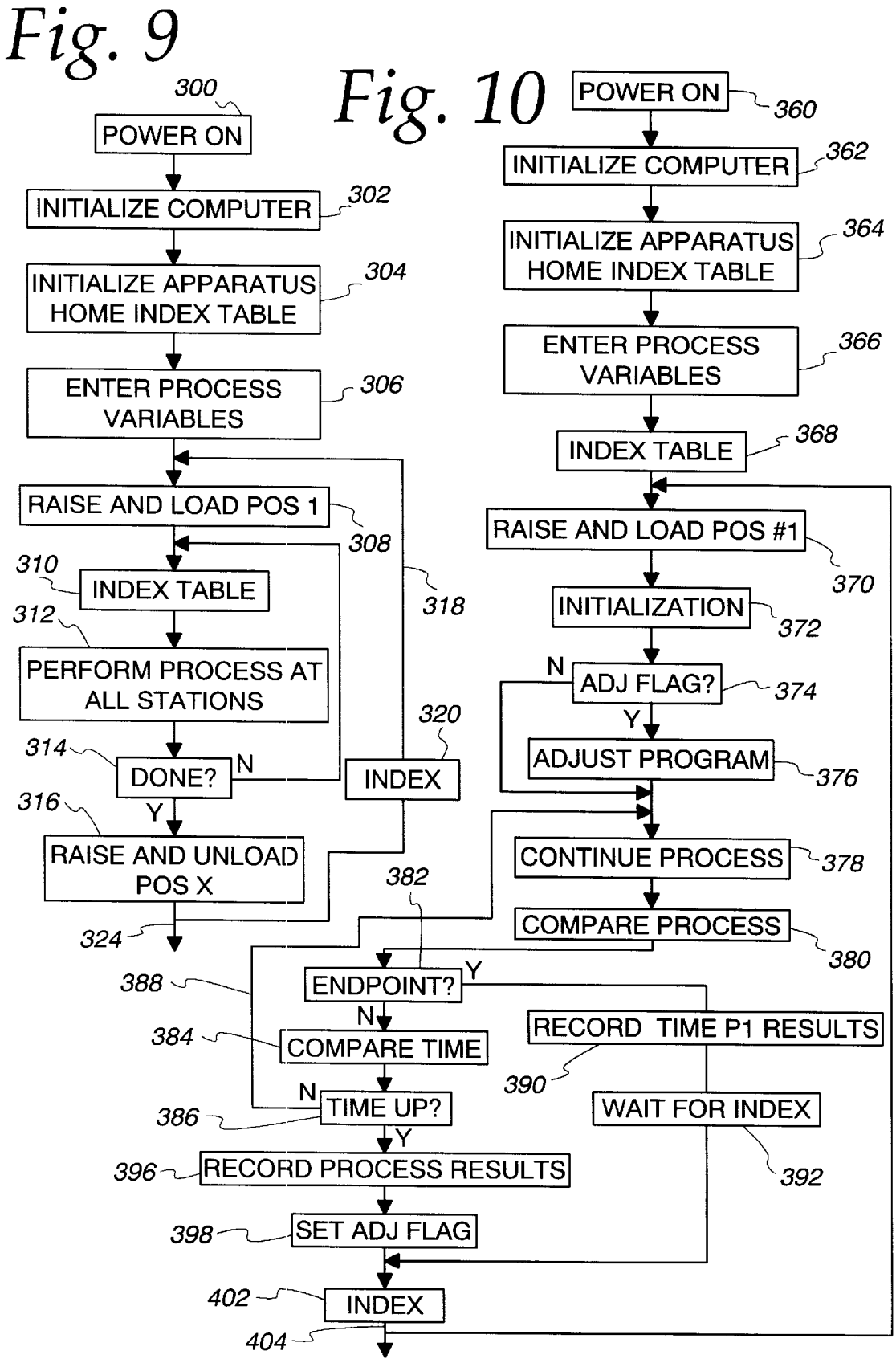
Fig. 9
300
POWER ON
INITIALIZE COMPUTER
302
INITIALIZE APPARATUS HOME INDEX TABLE
304
ENTER PROCESS VARIABLES
306
RAISE AND LOAD POS 1
308
310
INDEX TABLE
312
PERFORM PROCESS AT ALL STATIONS
314
DONE?
N
Y
316
RAISE AND UNLOAD POS X
318
320
INDEX
324
Fig. 10
POWER ON
360
INITIALIZE COMPUTER
362
INITIALIZE APPARATUS HOME INDEX TABLE
364
ENTER PROCESS VARIABLES
366
INDEX TABLE
368
RAISE AND LOAD POS #1
370
INITIALIZATION
372
N
ADJ FLAG?
374
Y
ADJUST PROGRAM
376
CONTINUE PROCESS
378
COMPARE PROCESS
380
382
388
ENDPOINT?
Y
N
384
COMPARE TIME
RECORD TIME P1 RESULTS
390
N
TIME UP?
386
WAIT FOR INDEX
Y
392
396
RECORD PROCESS RESULTS
398
SET ADJ FLAG
402
INDEX
404

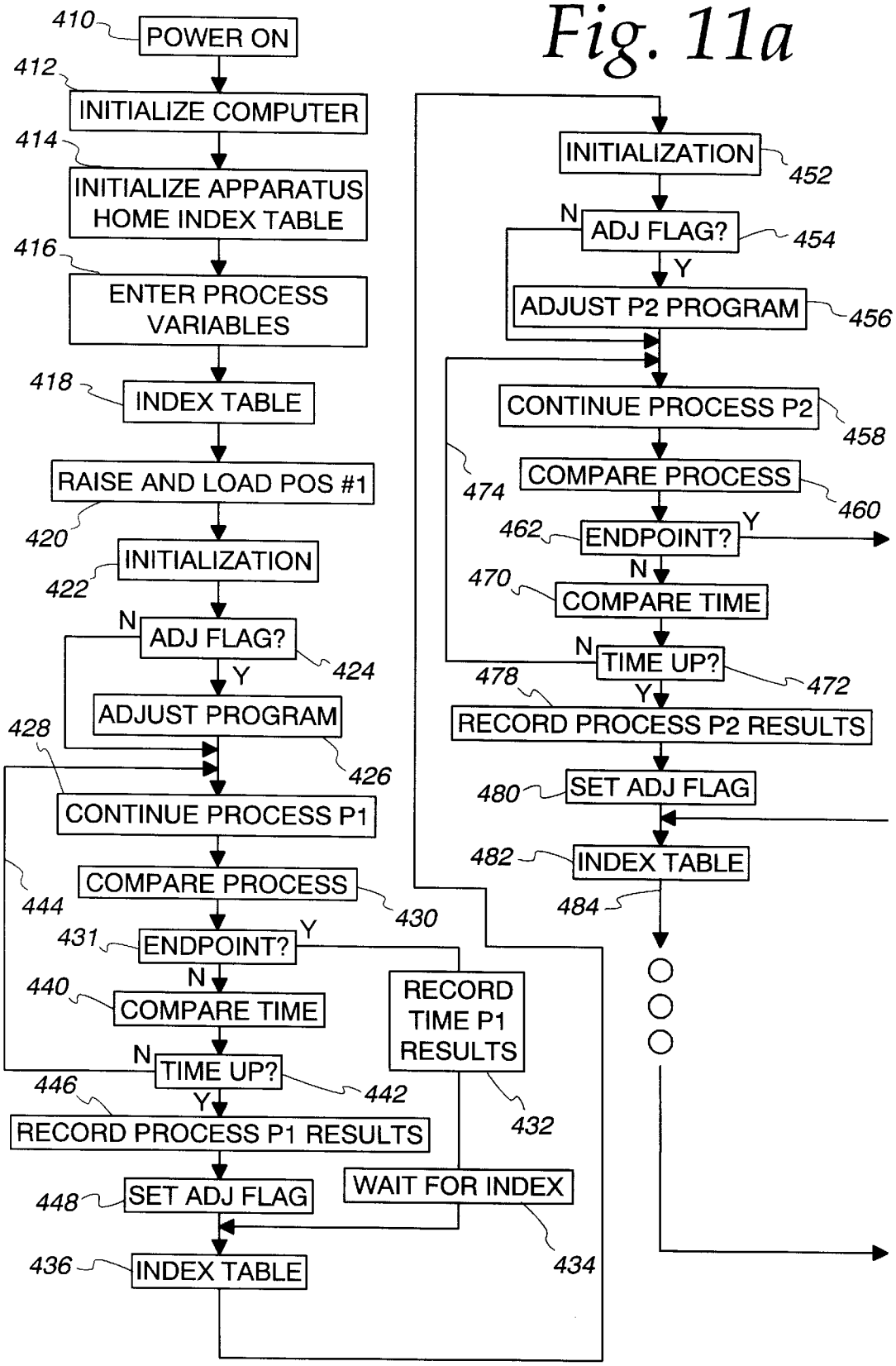
Fig. 11a
410
POWER ON
412
INITIALIZE COMPUTER
414
INITIALIZE APPARATUS HOME INDEX TABLE
416
ENTER PROCESS VARIABLES
418
INDEX TABLE
RAISE AND LOAD POS #1
420
INITIALIZATION
422
N
ADJ FLAG?
424
Y
ADJUST PROGRAM
428
426
CONTINUE PROCESS P1
COMPARE PROCESS
444
430
431
ENDPOINT?
Y
N
440
COMPARE TIME
RECORD TIME P1 RESULTS
N
TIME UP?
442
446
Y
RECORD PROCESS P1 RESULTS
432
448
SET ADJ FLAG
WAIT FOR INDEX
436
INDEX TABLE
434
INITIALIZATION
452
N
ADJ FLAG?
454
Y
ADJUST P2 PROGRAM
456
CONTINUE PROCESS P2
458
474
COMPARE PROCESS
460
462
ENDPOINT?
Y
N
470
COMPARE TIME
N
TIME UP?
472
478
Y
RECORD PROCESS P2 RESULTS
480
SET ADJ FLAG
482
INDEX TABLE
484

APPARATUS AND METHOD FOR THE FACE-UP SURFACE TREATMENT OF WAFERS

BACKGROUND OF THE INVENTION

1. Field of the Invention

The present invention pertains to the surface treatment of workpieces and in particular to polishing and the like surface treatment operations performed on semiconductor wafers.

2. Description of the Related Art

High quality semiconductor wafers are used in the commercial production of integrated circuit devices, with each wafer ultimately being divided to provide a relatively large number of such devices. Repeated detailed processing is required during integrated circuit production. The inherent value of the semiconductor wafer blank is relatively high, and increases dramatically as additional operations are performed on it. One figure of merit for cost reduction of integrated circuit production is the number of integrated circuit devices that can be obtained from a particular semiconductor wafer. With the continued miniaturization of electronic components, the finished size of integrated circuit devices is becoming smaller.

Accordingly, as the number of circuits (or circuit density) on a semiconductor wafer increases, the spacing between adjacent electronic structures (e.g. conductive lines) is being dramatically reduced in size. It has been found convenient to operate on the semiconductor wafers in multiple stage mass operations, each stage developing a layer of circuitry throughout the entire wafer, in a single operation. Such operations typically employ photographic techniques. However, as the relative size of the electronic devices is reduced, the focus and depth of field of the imaging processes used for integrated circuit production becomes increasingly sensitive to surface variations on the semiconductor wafer substrate. This has increased the desire for semiconductor wafers with improved surfaces, especially surfaces having improved flatness. During the fabrication process, layers are added to, or incorporated in, the semiconductor wafer surface, with conductors and dielectric structures being built on top of underlying layers. It has been found necessary to restore the desired flatness of the resulting exposed surface after each such operation.

Restoring flatness of a semiconductor wafer (commonly referred to as "planarization") is achieved using various wafer polishing techniques. Such polishing generally includes attaching one side of the semiconductor wafer to a flat reference surface of a wafer carrier or chuck, and pressing the exposed surface of the wafer against a flat polishing surface. During the polishing operation, both the polishing surface and the wafer surface may be rotated or made to undergo relative oscillation to further improve the polishing action. The polishing surface typically comprises a pad attached to a rigid flat table. A specially composed slurry having desired abrasive and/or chemical properties is introduced into the polishing process. The combined effects of the pad, the slurry and the relative movements of the wafer and polishing surface produce an enhanced chemical/mechanical treatment of the wafer surface.

One important objective of practical polishing operations for integrated circuit production is to reduce surface variations to a low level (e.g., less than 0.1 micron). Although substantial advances have been made over the years to allow the attainment of an extremely flat surface, precision processing has required attention to virtually every component of the overall process. For example, considerable attention has been paid to the production and post production enhancement of polishing pads which are relied upon to perform mechanical work on the semiconductor substrate surfaces and to carry the chemical and abrasive components of the slurry. It has been observed that spent particles developed during the polishing process become embedded within the polishing pad, changing its precisely controlled characteristics and requiring pad replacement on a relatively frequent basis. Accordingly, polishing pads are considered to be a consumable component of the polishing operation. However, the processing and post processing treatment of the polishing pads, in order to attain the precision surface properties necessary to impart the desired flatness to a semiconductor wafer, is achieved at a considerable cost. Recent industrial proposals have raised a likelihood of substantially increasing semiconductor wafer sizes from 8 inch to 12 inch diameter sizes. Considerable cost and technological differences have been encountered in the past when substantial increases in polish pad sizes have been proposed. Speed of wafer polishing, or in a production setting, wafer throughput, has always been of interest and lies behind the drive to overcome the substantial challenges presented with larger wafer sizes. Methods and apparatus to produce improved polishing, particularly rapid automated polishing of larger sized semiconductor wafers, is desired, and these needs are met by the present invention.

SUMMARY OF THE INVENTION

It is an object of the present invention to provide apparatus and method for the automated polishing of semiconductor wafers and similar components.

Another object of the present invention is to provide apparatus and methods which are capable of flexible operation, where different modes of surface treatments can be provided on an ongoing, routine basis.

Another object of the present invention is to provide apparatus and methods for the surface treatment of wafers in which multiple individually controlled processes are performed on each wafer.

These and other objects of the present invention which will become apparent from studying the appended description and drawing are provided in an arrangement for polishing a surface of a semiconductor wafer, comprising:

- a support structure;
- a carrier table having a central axis and carried by the support structure for rotation about the central axis, the carrier table defining a plurality of wafer-receiving positions each having an upper, support surface for supporting the semiconductor wafer;
- a plurality of polishing positions, each including a polish pad carried by a polishing head which is movable toward and away from said carrier table, into and out of pressing engagement with semiconductor wafers carried on said carrier table;
- index means for indexing said carrier table so that a semiconductor wafer is moved from one polishing position to another; and
- control means controlling said polishing heads and said index table so that a semiconductor wafer carried on said carrier table is polished by a plurality of polishing heads.

BRIEF DESCRIPTION OF THE DRAWINGS

FIGS. 9–11 are schematic flow diagrams showing the sequence of operation of the polishing apparatus.

DETAILED DESCRIPTION OF THE PREFERRED EMBODIMENTS

Figure 1:
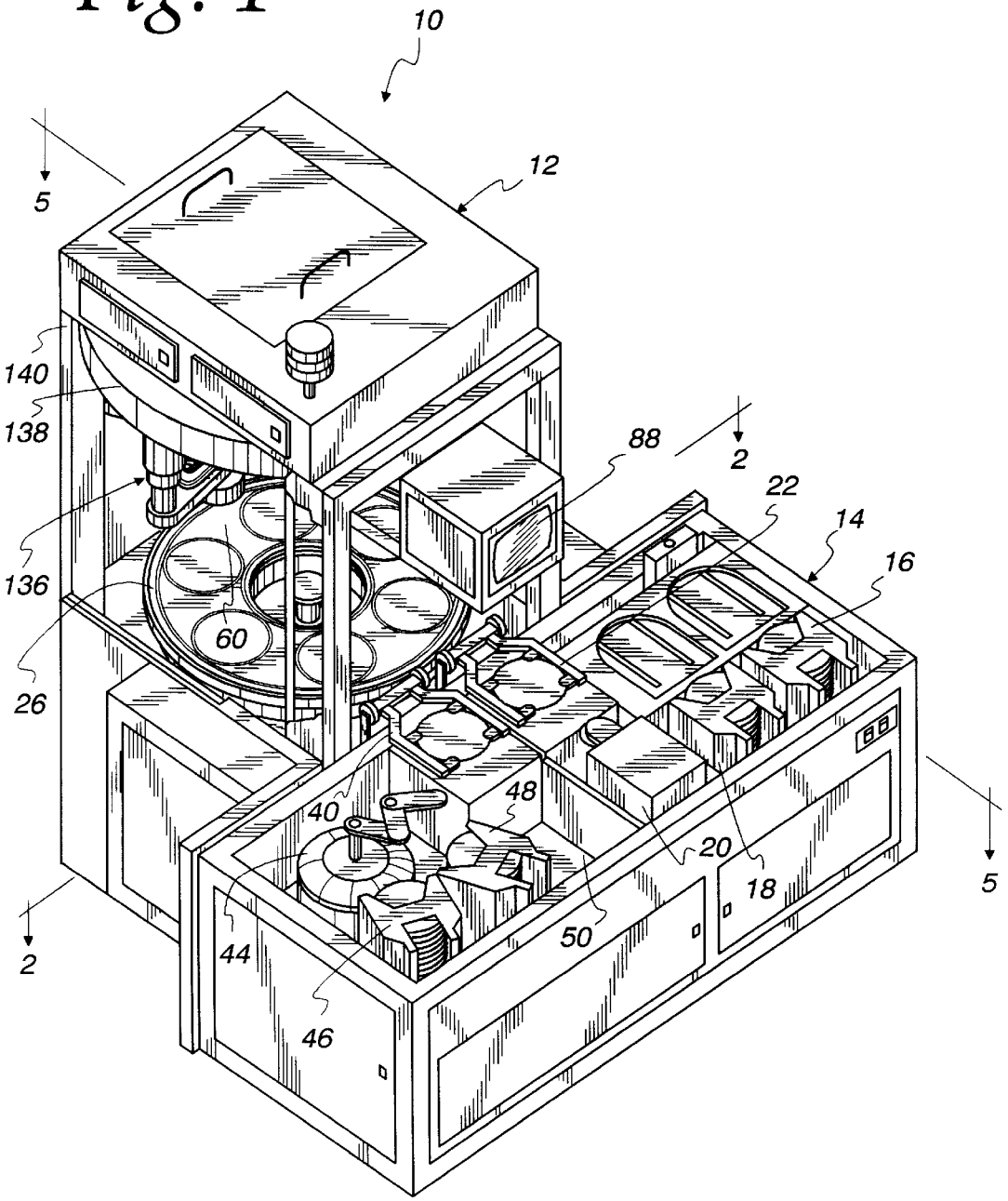
FIG. 1 is a perspective view of wafer polishing apparatus according to principles of the present invention.

Referring now to the drawings and initially to FIGS. 1–6, apparatus 10 is shown for the surface treatment (especially polishing) of semiconductor wafers and other types of workpieces having a surface to be treated (e.g., flattened, polished, or planarized). Apparatus 10 includes a process module 12 and an input/output module 14. The process apparatus 12 can be employed in a number of ways. For example, wafers or other workpieces can be manually loaded and unloaded. However, it is generally preferred that the input/output module 14 be provided for automatic mass production operation. Accordingly, input/output module 14 includes an input section with input cassettes 16 and 18 and an input for loading robot 20. An input gripper 22 grips the edges of the wafer in the manner shown in FIG. 1.

The wafers are loaded on a carrier table 26. As shown in the preferred embodiment, carrier table 26 has six wafer-receiving positions 31–36, with the position opposite the load arm 22 being the first position, which is identified in FIG. 2 by the reference numeral 31. The remaining positions are identified by reference numerals 32–36. The wafer positions 31–36 referred to herein have a fixed spatial location, such that a particular wafer undergoes a change in wafer position each time indexing of the carrier is carried out. The sixth position (see reference numeral 36 in FIG. 2) is located opposite an unload arm 40, which removes wafers from carrier table 26 for presentation to a scrubber robot 44. Unloaded wafers are then stored in cassettes 46, 48. Preferably, input/output module 14 can be adapted for submerged operation with the interior cavity 50 of the input/output module being filled with a suitable protective fluid, such as treated water.

Figure 2:
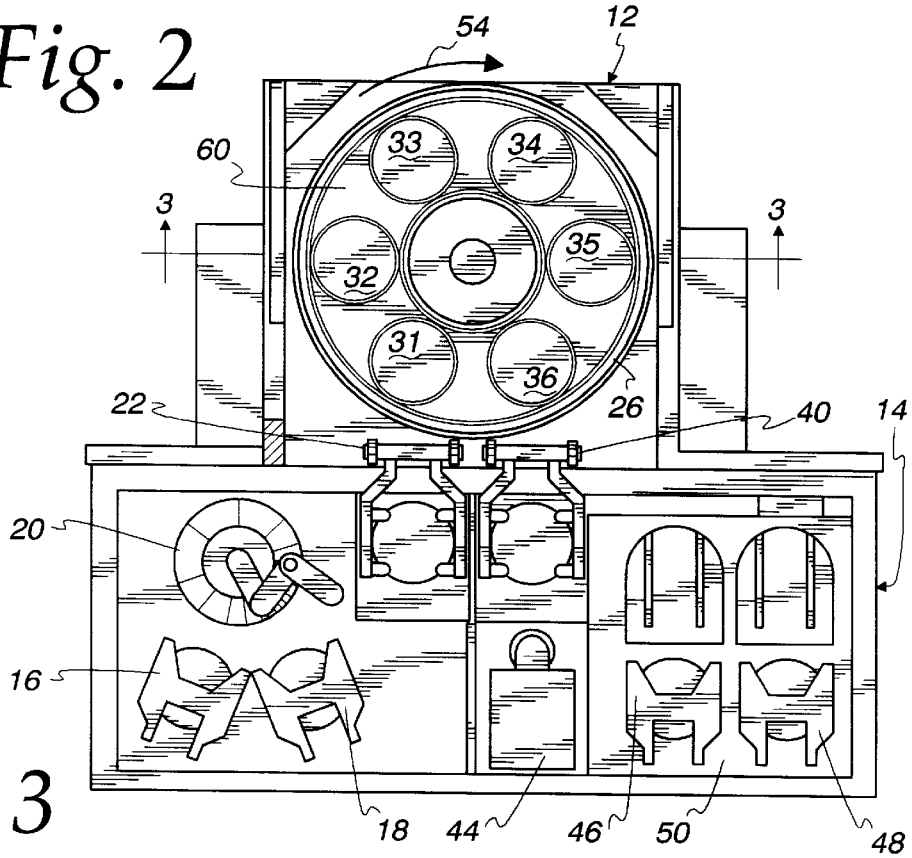
FIG. 2 is a cross-sectional view thereof taken along the line 2—2 of FIG. 1.
Figure 3:
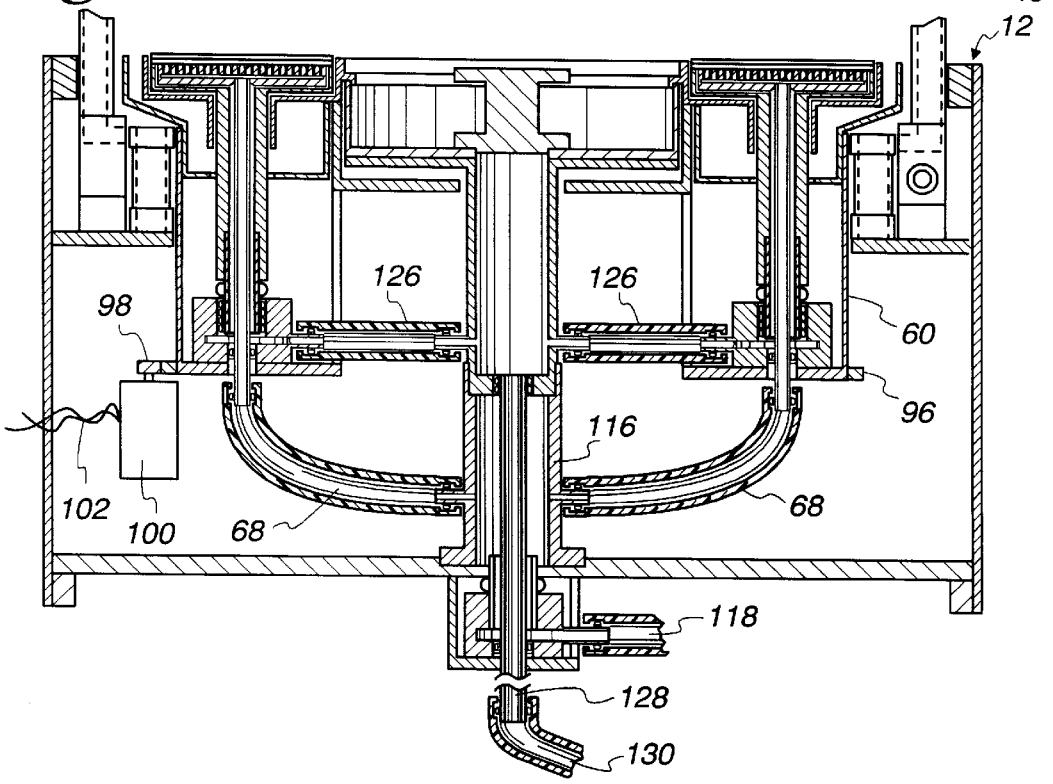
FIG. 3 is a cross-sectional elevational view thereof taken along the line 3—3 of FIG. 2.
Figure 6:
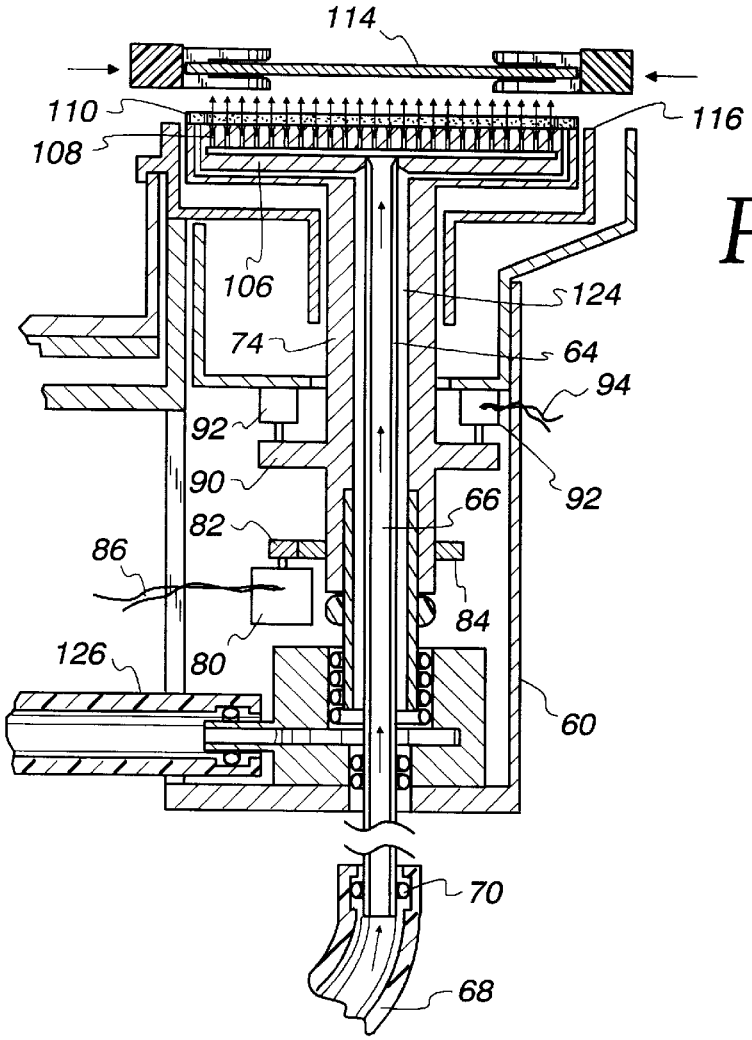
FIG. 6 is a view similar to that of FIG. 4, but showing the wafer being removed.

Referring to FIG. 2, carrier table 26 includes a rotatable annular ring 60 carrying the six wafer positions 31–36. Carrier ring 60 is mounted for indexing by rotation about its central axis in the direction of arrow 54, but is otherwise stationary, remaining at a fixed location within process module 12. Referring to FIG. 3, a gear ring 96 meshes with a drive gear 98 rotatably driven by motor 100 which is coupled through conductors 102 to central control unit 88. As motor 100 is energized, carrier ring 60 is indexed 60 degrees. Referring to FIG. 6, each wafer position includes a central shaft 64 having a hollow interior 66 for the passage of air flow provided by flexible conduit 68. As will be seen, the central shaft 64 is driven for rotation about its central axis and accordingly, the flexible conduit 68 is provided with a rotatable coupling 70.

Central shaft 64 is carried within an outer housing 74. Outer housing 74 is mounted for rotation within ring 60. Outer housing 74 and central shaft 64 are driven for rotation about their common central axis by a conventional drive arrangement schematically indicated in FIG. 6 by a motor 80 coupled through drive gears 82, 84 to outer housing 74. Motor 80 is coupled through conductors 86 to a central control unit 88 (see FIG. 1).

Referring again to FIG. 6, the outer housing 74 includes an outwardly directed flange 90 coupled to a plurality of actuators 92 mounted to ring 60. Actuators 92 are operated under control signals traveling along conductors 94 which couple the actuators 92 to the central control unit 88. When energized, actuators 92 lift the outer housing 74 and the wafer supported thereon a slight amount in the manner indicated in FIG. 6, so as to enable the gripper arms 22, 40 to load and unload wafers.

Referring again to FIG. 6, a carrier 106 is mounted atop central shaft 64 and includes a plurality of internal air passageways 108 communicating with its upper exposed surface. A backing pad 110 is mounted atop carrier 106 so as to directly contact wafers 114 to provide direct support for the wafers during a polishing operation. In the preferred embodiment, the backing pad 110 is sufficiently porous to pass the air flow from central support 64. With reference to FIG. 3, air flow travels along the conduit 118 and through internal passageways in the hollow central column 116 to the conduit 68.

Preferably, as will be seen herein, a fluid slurry composition is employed during a polishing process to provide an enhanced chemical/mechanical polishing capability. Although the wafers are presented to the apparatus for polishing, it will be appreciated that even in an unpolished state the wafers are quite smooth. Accordingly, wafers 114 have been observed to become affixed to the backing pad 110 by suction forces. As indicated in FIG. 6 and in the other figures, the wafers are grasped at their outer edges for transport back and forth to the input/output module 14.

It has been found desirable to provide an air assist for the unloading operation, as illustrated in FIG. 6. Pressurized air travels through the hollow central shaft 66, directing pressurized air through backing pad 110 as indicated by the arrows in FIG. 6, thus breaking suction forces that would impair lift-off of the wafer from the process apparatus. If desired, the same air conduit system can be used to apply a slight vacuum to the backing pad 110 after a wafer has been loaded thereon, although application of a vacuum to the central portion of the wafer has not been found to be necessary.

As illustrated in FIG. 6, an additional air passageway 124 communicates with the outer periphery of vacuum pad 110. With additional reference to FIG. 3, passageway 124 is coupled through a conduit 126 to the central column 116. Air flow is coupled through a tube 128 to a flexible conduit 130. A vacuum signal applied to flexible conduit 130 is applied through passageway 124 to the outer periphery of vacuum pad 110 and the wafer placed thereon, in the manner illustrated in FIG. 7.

Referring again to FIG. 1, a plurality of polish head assemblies generally indicated at 136 are suspended from a housing 138, being mounted at the upper portion of the support structure 140 of processing module 12. Preferably, polish head assemblies are positioned at fixed work stations, located adjacent each active position of the carrier table (i.e., positions 32–35). Accordingly, there are four work stations associated with housing 138, each capable of providing an independent polishing operation.

Figure 4:
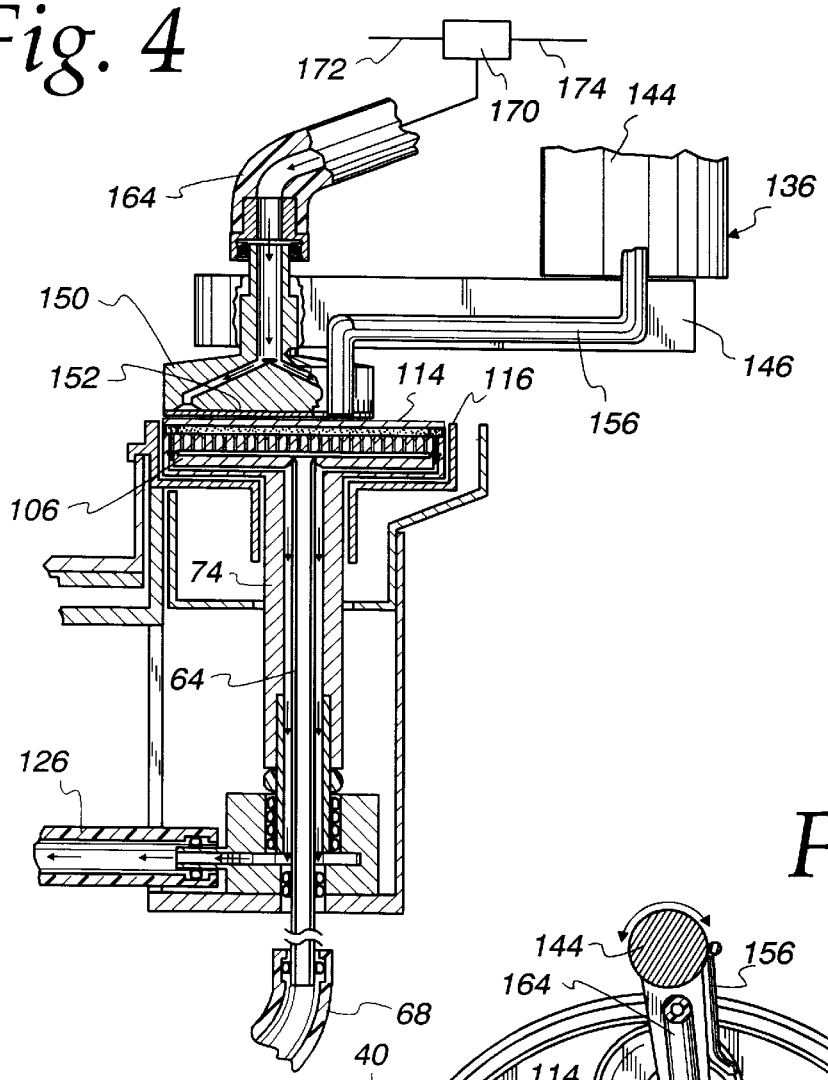
FIG. 4 is a fragmentary cross-sectional view of the right hand portion of FIG. 3, shown on an enlarged scale, and showing a polishing head in cooperation therewith.
Figure 5:
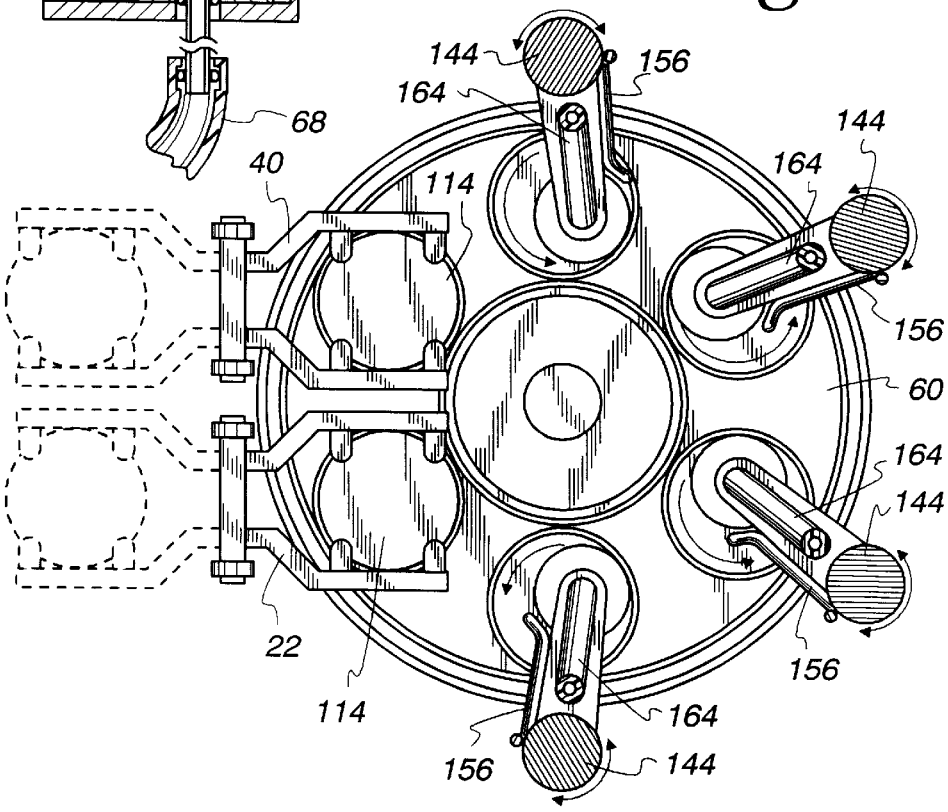
FIG. 5 is a cross-sectional view taken along the line 5—5 of FIG. 1.
Figure 7:
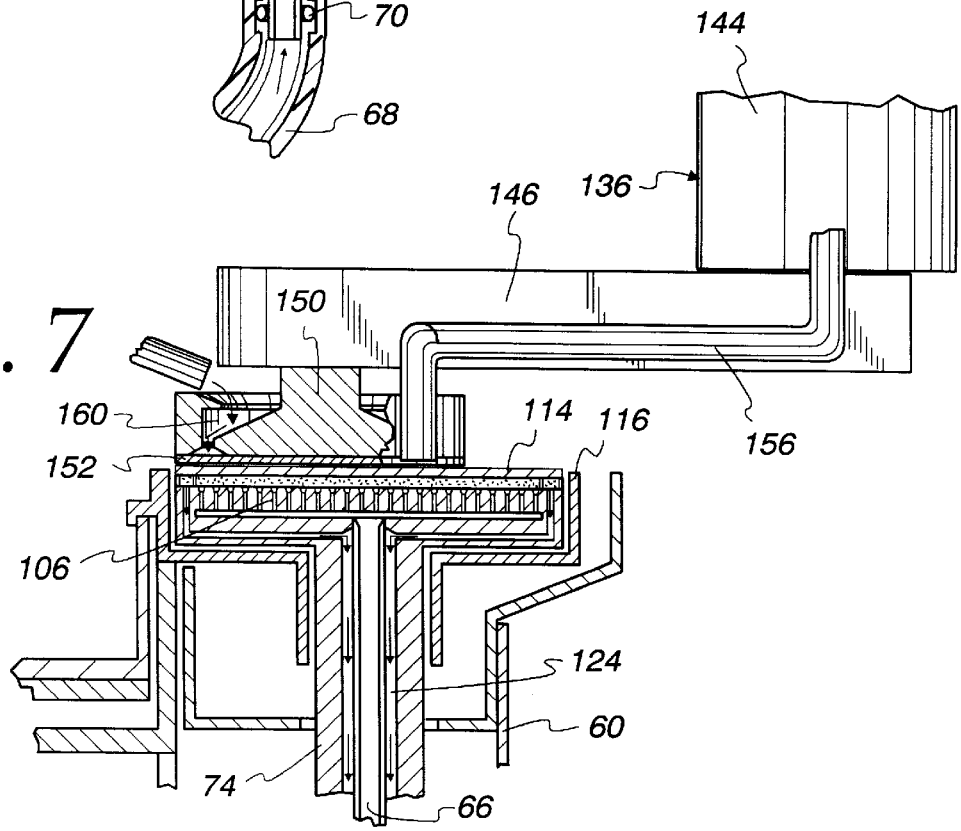
FIG. 7 is a fragmentary cross-sectional view showing a portion of FIG. 4 on an enlarged scale.

Referring additionally to FIGS. 4 and 7, the polish head assemblies 136 include a support 144 with a transverse arm 146 extending therefrom in a cantilever fashion. As seen in FIG. 7, polish head assembly 136 includes a polish head 150 carried at the free end of transverse arm 146. A polish pad 152 is carried on the bottom face of polish wheel 150. Drive mechanism (not shown) is contained within transverse arm 146 to drive polish head 150 about its central, vertical axis. A conventional probe 156 is carried on the outside of the transverse arm 146 to monitor the upper surface of wafer 114. Probe 156 is coupled to control system 88 and provides a continuous update of the surface characteristics of wafer 114. Probe 156 may, for example, be of a type used in polishing endpoint detection.

Turning to FIG. 4, an arrangement for delivering slurry is illustrated. In FIG. 4, internal passageways are provided within polish head 150 and a flexible conduit 164 is coupled to polish head 150 in the manner indicated. In FIG. 4, the slurry travels through polish pad 152 so as to be introduced between the polish pad and the upper surface of wafer 114.

As will be seen herein, a semiconductor wafer is transferred from one processing station to another with different multiple processes being performed in sequence. As mentioned above, the different processes may require a different pH value. Accordingly, as schematically indicated in FIG. 4, a feed valve 170 is operated under control of control unit 88 to deliver either slurry or rinse water to conduit 164 via feed lines 172, 174. Thus, if time permits at the end of a polishing process, feed valve 170 is activated to direct feed water to the polish head and polish pad to flood the semiconductor wafer with rinse water so as to remove most of the slurry from the active polish region. Although the semiconductor wafer will not, strictly speaking, be totally cleaned by the post polish rinse, the transfer of slurry from one work station to another will be greatly reduced.

Figure 8:
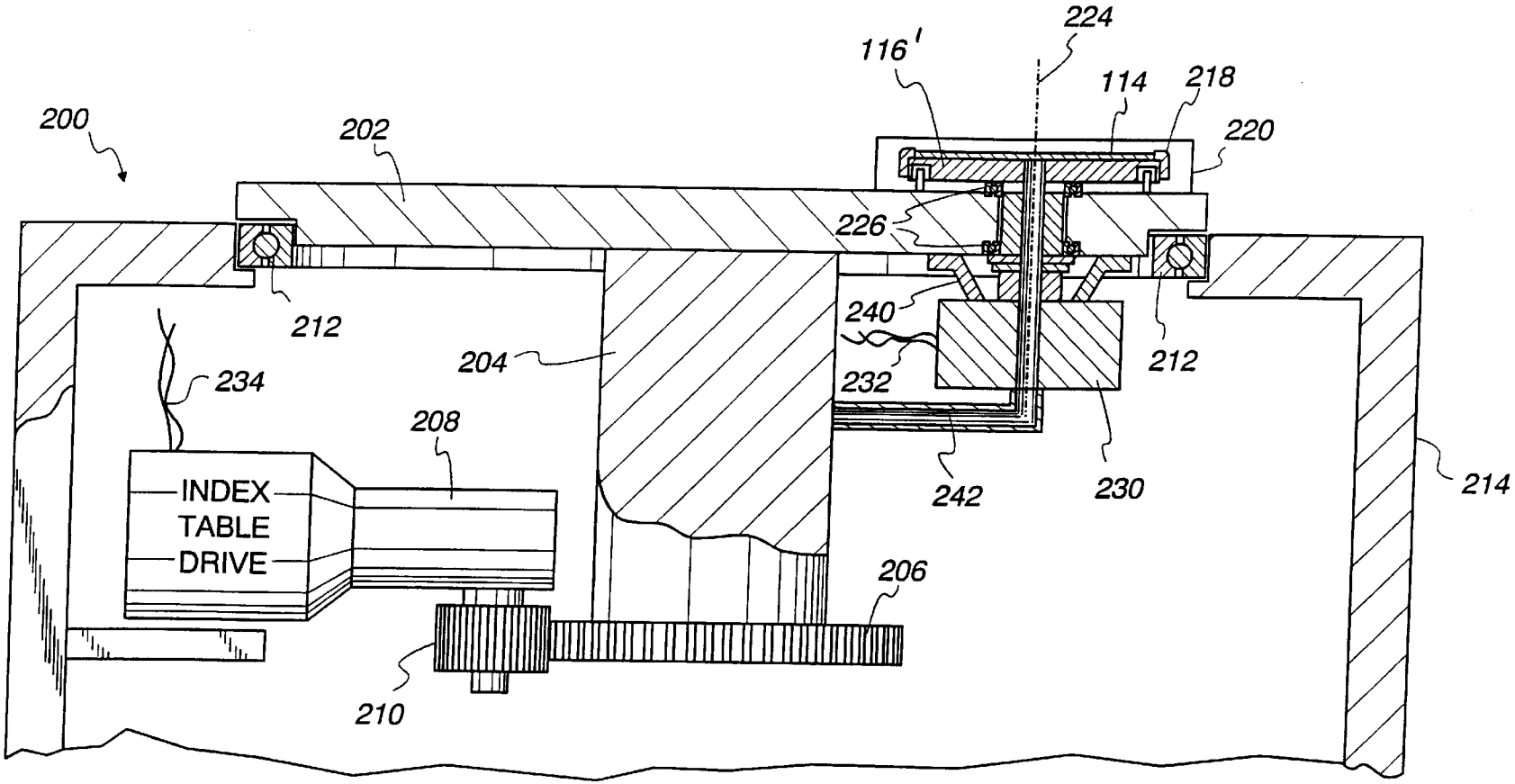
FIG. 8 is a view similar to that of FIG. 3 but showing an alternative table design.

Turning now to FIG. 8, an alternative carrier table arrangement is generally indicated at 200. A carrier table 202 is supported from below by a support pedestal 204. Pedestal 204 includes a gear 206 driven by motor 208 through a gear 210. Table 202 is mounted at 212 for rotation about a support base 214. As with the preceding embodiments, six positions are provided on the carrier table, however, only one such position is shown in FIG. 8 for clarity of illustration.

A guide ring 218 is located within a housing 220. Semiconductor wafer 114 is mounted atop a table and pressure pad arrangement designated by the reference numeral 116'. Backing table and pressure arrangement 116' is mounted for rotation about its central axis 224 by conventional ball bearing arrangements 226. An optional drive motor 230 drives the backing pad for rotation in the desired direction and with the proper speed. Control unit 88 (see FIG. 1) is coupled to motor 230 via conductors 232 and to table drive motor 208 via conductors 234. As indicated in FIG. 8, motor 230 is mounted to the underside of table 202 by mounting legs 240. A conduit 242 is coupled through slip rings to a source of pressurized air (not shown) located within pedestal 204. The pressurized air is used in the manner indicated in FIG. 6 to help removal of the semiconductor wafer from the backing pad. It is preferable in this regard that a conventional solenoid (not shown) be mounted to table 202 so as to lift wafer 214 above the surrounding member 220, in the manner shown in FIG. 6, so as to allow the gripper arms 22, 40, free access to the wafer edges.

Certain operational details will now be discussed. The following sequence of operation traces the path of a single semiconductor wafer through the polishing apparatus. As mentioned above, the carrier table 26 and its associated movable ring 60 includes six positions for receiving semiconductor wafers to be polished. Four polishing arrangements are mounted in housing 138 above the carrier table, in alignment with four of the wafer positions of the carrier table. At each of the four polishing sites the paired combinations of polishing arrangements and wafer positions function as uniformly spaced-apart work stations. Cassettes with wafers to be processed are loaded at 16, 18 and are transferred by robot 20 to loading arm 22 to wafer position 31, as illustrated in FIG. 2. As mentioned, the wafer position numbers 31–36, as used herein, remain fixed in location despite rotation of index ring 60. In the preferred embodiment, the four polishing arms are located above the wafer positions 32–35 with wafer positions 31 and 36 being reserved for wafer load and unload.

In the present embodiment, wafers are simultaneously polished, four at a time, but polishing of each individual wafer is completed only when the wafer has been polished at at least two, and most preferably, all four of the polishing work stations. Accordingly, upon start-up of the polishing apparatus, and after the first wafer is loaded onto the index ring 60 at position 31, index drive motor 100 is energized under management of control system 88 to move the index ring 60 degrees in the counterclockwise direction of arrow 54. Accordingly, the wafer loaded at position 31 is now moved to position 32, underneath the first polishing arrangement suspended from housing 138 (see FIG. 1). The polish head 150 is lowered, with the polish pad 152 being placed in contact with the semiconductor wafer, and slurry is introduced through the polishing pad to the semiconductor wafer surface.

According to initialization procedures in the apparatus and in control system 88, polishing operations are suspended at work stations 33–35 during the first polishing cycle, while polishing is carried out only at work station 32. During this time, a second wafer is loaded at position 31 by load arm 22. The progress of polishing at station 32 is monitored, preferably continuously, by probe 156. As mentioned, it is anticipated that the polishing operation will not be completed at position 32 and it is further recognized that the part of the polishing step allotted to the work station 32 may not be completed as desired, and that adjustments to the downstream operations at positions 33–35 may be required. In any event, data indicating the progress of polishing at wafer position 32 is stored in the control system 88. Ongoing polishing operation at position 32 may be terminated either by control system 88, upon processing data from the monitoring probe with the resultant determination that the assigned polishing end point has been readied. Alternatively, an ongoing polishing operation at position 32 may be terminated on a time-out condition in which control system 88 mandates that the wafer carrier ring be indexed and the wafers advanced to the next polishing station.

During the next cycle of operation, carrier ring 60 is indexed in the direction of arrow 54 and the wafer formerly present at position 32 is moved to position 33. The polishing work stations located above positions 32 and 33 are lowered into operation, under control of unit 88 and the second polishing step on the wafer in position 33 is then carried out. Control unit 88 may carry out polishing at position 33 according to a previously programmed arrangement, which preferably remains unchanged from one polishing cycle to another.

Alternatively, control unit 88 may call for the control program to rewrite itself, in effect, to adjust the preassigned program for polishing at position 33, based upon data collected during the previous polishing cycle at position 32. For example, if polishing at position 32 was observed to be incomplete, program control would respond by recognizing that increased polishing is required at position 33 (and perhaps at other downstream positions as well). Accordingly, the polishing pressure applied to the wafer or the rate of relative rotation of the wafer and the polish pad, or both, may be increased to make up for the short fall in wafer processing at the upstream position 32.

It is generally preferred that polishing at position 33 be continuously monitored by probe 156 located at that position, and that upon completion of the polishing cycle, the resultant data indicating the polishing process at position 33 be stored in control unit 88. Again, polishing at position 33 may be terminated either upon indication by probe data of successful attainment of a polishing end point or, alternatively, polishing may be terminated prematurely on a time-out condition. In either event, control unit 88 calls for the carrier ring 60 to be indexed in a direction of arrow 54 moving the wafer at position 33 to the new position 34.

Polishing at position 34 continues either according to a prearranged program, or under control of a program modified according to probe data indicating polishing results at the upstream position. When polishing of the wafer at table position 34 is completed, control unit 88 calls for carrier ring 60 to be indexed in the direction of arrow 54, bringing the wafer to the final work station above table position 35. Surface treatment is carried out according to a prearranged program step or according to a program step which is modified to account for surface treatment results at the upstream work station. In the preferred embodiment, table position 35 is devoted to cleaning rather than polishing. As mentioned above, rinse water may be introduced in the polishing heads at upstream positions. However, such rinsing operations are used to flush the slurry off of the wafer before transport to a downstream work station, and is not relied upon for the necessary cleaning of the semiconductor wafer. Accordingly, it is preferred that specialized wafer cleaning equipment be employed at table position 35.

Upon completion of the operations at table position 35, control unit 88 calls for the carrier ring 50 to be indexed in the direction of arrow 54 and the semiconductor wafer is then moved to table position 36, which, in the preferred embodiment, comprises the output position, located opposite transfer arm 40. Scrubber robot 44 transfers the finished wafer from transfer arm 40 to output cassettes 46, 48. Accordingly, upon a subsequent indexing of the carrier ring an empty carrier is presented to the input table position 31 in preparation for a loading step during the next cycle of operation.

During the following cycle of operation, transfer arm 22 loads a fresh semiconductor wafer onto the carrier equipment at table position 31 so that the wafer is ready upon indexing of the carrier ring and the next polishing cycle.

The present invention contemplates that certain economies of operation can be obtained by simultaneous management of all of the work stations. For example, it is possible using known programming techniques, to monitor the average throughput rate for wafers being processed during a particular work shift. If a problem develops at a particular work station where, for purposes of example, polishing progress is unexpectedly slow, it may be advantageous to terminate further polishing at the work station in an effort to attain a consistent average throughput rate of the overall machine. An error flag can be noted for the wafer's output data and can be transferred to subsequent work stations in an effort to "make up" the polishing needed during successive cycles of operation. It may be necessary, in order to attain a maximum average throughput rate, that the wafer in question be "tagged" for subsequent off stream operations.

As a further possibility, it may be observed that polishing process is consistently unexpectedly slow at a particular work station position. It is possible, and it may be confirmed by software review of the polishing data, that the polishing pad for the work station is nearing the end of its useful life. Bearing in mind that the present invention may be employed in clean room environments, it may be advantageous to forego replacement of the polishing pad for some period of time, for example, to the end of the work shift. It may be possible in this event, to switch the entire machine over to a new pre-programmed operation which ignores the work station in question. Such alternative operation would inevitably result in a lower average throughput but, as proposed, it may be more desirable at times to operate in this manner.

As mentioned above, semiconductor wafers or other workpieces processed according to the present invention are operated upon at two or more successive work stations. The above discussion focused on the overall work stations performing similar polishing steps using similar polishing equipment. However, the present invention is also intended for use in more complicated operating scenarios. For example, the various work stations can employ polishing slurries of different abrasive and/or chemical properties, especially different pH values. The different work stations could also employ polishing heads having different abrasion, backing pad resilience, cushioning resilience, and other physical or mechanical surface treatment properties. Further, the different work stations could have polish heads and/or wafer carrier operating at different speeds and/or different directions.

While the present invention contemplates the continuous monitoring of polishing pressures at each work station, different work stations can be operated at different ranges of polishing pressures. Further, the polishing pads and/or the polishing heads can have different curvatures with local, and more particularly, global planarity being attained by polishing the wafer with pads of different curvatures for variable independently controlled times. For example, wafer polishing may first be carried out using a convex curved polish pad and at a subsequent station polished using a concave curved polish pad. Obviously, combinations of the above variations may be provided by the polishing arrangement.

Other variations are also possible. For example, a carrier ring having six wafer positions and an overlying polish head arrangement having four polishing stations is described. Carrier tables and polishing stations accommodating different numbers of wafer carrier positions and polish stations, respectively, are possible. Further, although the carrier ring is mounted for rotation about an axis, a conveyor belt having an ovoid or race track configuration may be provided, with wafer carriers located throughout the conveyor belt. The polishing stations may be located at various positions above the conveyor belt, as desired.

Figure 11B:
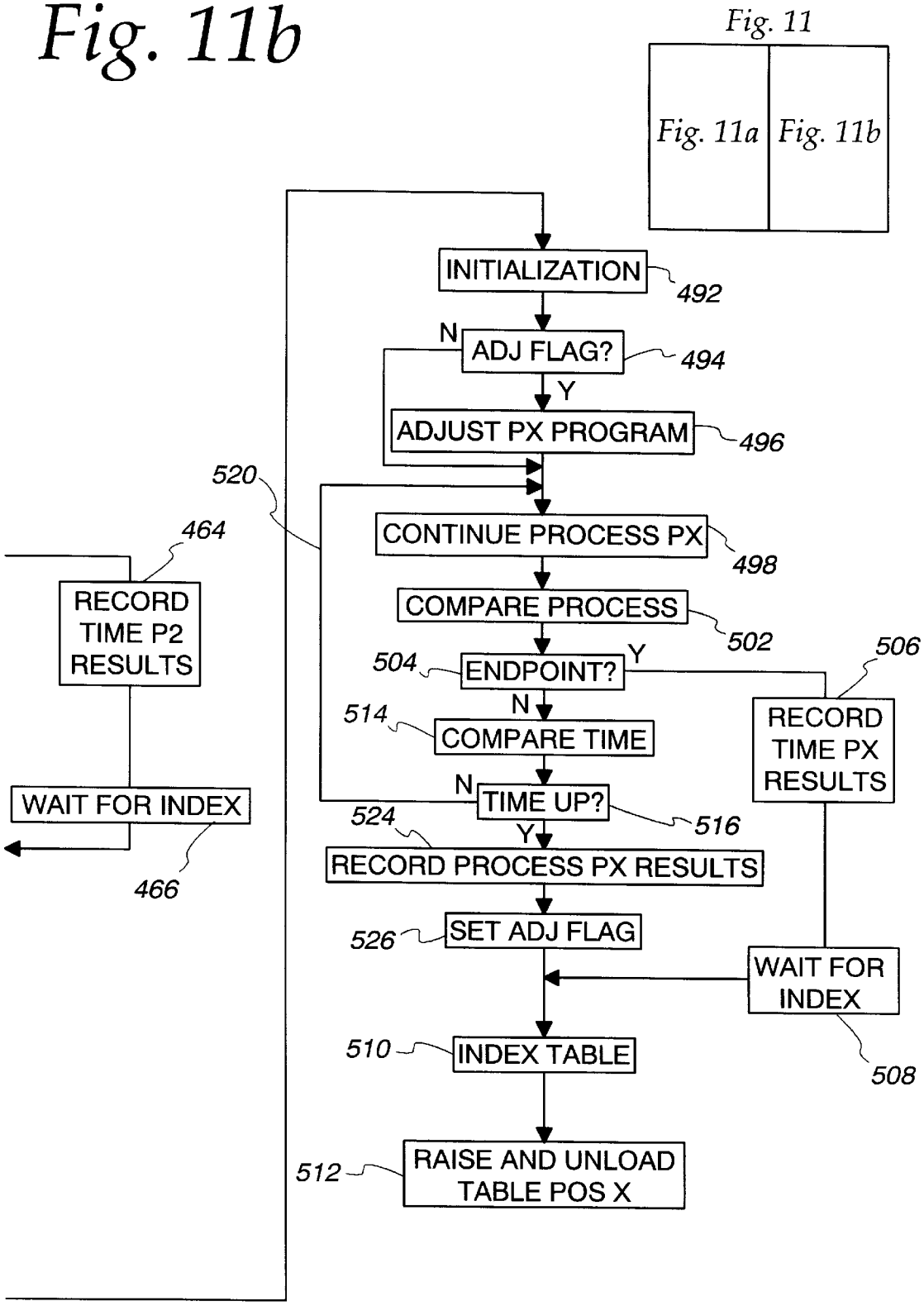

Turning now to FIGS. 9–11, operation of the polishing arrangement will be described with reference to various schematic flow diagrams. Beginning with FIG. 9, a schematic flow diagram tracking the progress of a single wafer through the polishing arrangement will be described. Control system 88 preferably includes a conventional microcomputer, with the usual associated memory, and suitable input/output interfaces for controlling and sensing production processes. At power-on of the assembly indicated by block 300, the computer is initialized under the software control of system 88, confirming that the associated data input devices are successfully operating, and that the so-called hardware components of the system (see block 304) are initialized or set to their "home" or "ready" positions. For example, carrier ring 60 is set to a predetermined "home" position and optionally, the absence of semiconductor wafers may be confirmed at each of the carrier positions. As a further hardware initialization step, the presence of wafers in the input cassettes and the empty condition of output cassettes at wafer transfer station 14 may be confirmed, along with desired operation of transfer arms 22, 40. Further, the work stations are initialized, confirming that the polish heads are retracted away from the carrier table and optionally, the ability of the arms 146 to oscillate the polish head 150 back and forth with the desired range of motion may be verified. Further, if the wafer carriers are rotatably driven, the ability of the carriers to attain the desired rotational speed may be verified, along with the ability of the carrier ring to index in the desired manner.

Next, as indicated in step 306, the operator enters process variables in control system 88. As illustrated in FIG. 1, the control system includes a video monitor for communication of output data to the operator. The video monitor is preferably of the touch-screen type, allowing the operator to input information into the software control system. The process variables entered by the operator may, for example, identify certain polishing specifics for each work shift. For example, the relative hardness, surface characteristics and material type can be entered for the wafers to be processed. Initially, or further on in the operating period, the operator may adjust system polishing pressures or speeds, for example, either on an overall basis or for each individual work station.

Further, the operator can invoke the mode of operation to be carried out and can instruct the control system if a particular work station is out of operation or if other special conditions must be taken into account by the software control. It is generally preferred that the process specific parameters such as polish pressure, rotation speed of a particular process be maintained under management of the control system 88 with the operator providing high level commands. However, the possibility also exists that the operator can "train" the polishing machine to learn various programs of operation which can be thereafter repeated or automatically adjusted under software control.

Operation of the polishing system is now ready to be initiated, and the wafer carrier at the first or input position (see reference numeral 31 in FIG. 2) is raised in the manner indicated in FIG. 6, to prepare for receipt of a wafer carrier by input transfer arm 22, as indicated in block 308. In the next step 310, the carrier ring 50 is indexed to bring the newly loaded semiconductor wafer to the next position, underneath the first work station. Polishing is then initiated at the first work station as indicated by block 312. As mentioned above, all of the work station positions will eventually be filled with semiconductor wafers as machine process is continued. Block 312 indicates that those work stations having semiconductor wafers available will proceed according to a programmed process and eventually all four work stations 32–35 will be simultaneously operational. Progress of the surface treatment is checked in block 314 and process continues until an end point is reached. At this point, the carrier ring 60 as indexed and the unload position (position 36 in FIG. 2) is raised and the wafer unloaded therefrom in the manner indicated in FIG. 6, or as indicated in block 316.

After the semiconductor wafer is unloaded from carrier 36, the carrier ring 60 is indexed and, accordingly, the empty carrier is moved to position 31, opposite the input transfer arm 22. As indicated in FIG. 9 by the arrow 318, the processing phase of the operation is repeated at block 308 with the raising and loading of the wafer carrier at position 31.

In block 314 a decision is made as to whether the semiconductor wafer in question has traversed all of the desired processing work stations. If not, control is transferred to block 310 where the carrier ring is indexed with the wafer being delivered to a new, downstream work station. Processing at the new work station is continued under control of block 312. Eventually, decision block 314 detects that the semiconductor wafer has been successfully processed at the final work station 35 (see FIG. 2) and with a subsequent indexing of the carrier ring the finished wafer is presented to position 36 (see FIG. 2) where the wafer carrier is raised and unloaded in the manner indicated in FIG. 6.

If additional wafers are to be processed, carrier ring 60 is indexed as indicated in control block 320 and control is then transferred to block 308 as indicated by arrow 318. When all of wafers have been processed, control is continued as indicated by arrow 324 at the bottom of FIG. 9. The shut-down steps indicated by arrow 324 may include, for example, a final revision to the control program, based upon an averaging of observed performance data. Alternatively, the shut down process could merely comprise a check of the carrier positions to verify that the wafers have been removed and that the positions are empty. Further shut down procedures could involve flushing the slurry lines with wash water, and to return the polish heads to a home position.

Turning now to FIG. 10, a schematic diagram showing simplified operation of the overall polishing arrangement will be described. The system is powered up in block 360, the computer and control system are initialized in block 362, apparatus is initialized in block 364 and process variables are entered in block 366 as described above with reference to blocks 300–306 of FIG. 9. The carrier ring 60 is then indexed in an initial step indicated in block 368.

Control is then transferred to block 370 which sends instructions to solenoids 92 so as to raise support pad 110 (see FIG. 6). The load arm 22 brings a wafer into position above the backing pad. If desired, a vacuum signal can be applied to conduit 58 to help establish and maintain control over the wafer during the loading process. Solenoids 92 are then energized to lower the carrier support and wafer within the guide ring 116 to attain the position illustrated in FIG. 7. The wafer is now ready for polishing.

In block 372 any necessary initialization steps are performed to prepare the apparatus components for polishing. For example, control unit 88 can load a program module for controlling polishing at the individual work station of interest, if this has not been done previously. Apparatus needed to be rotated can be brought up to speed and the slurry feed lines charged with the proper slurry component. Further, the position of switch 170 needed to connect the slurry feed line 172 to the feed conduit 164 can be verified. During initial operation of the polishing machine an adjust flag would not be present and, accordingly, control block 374 would direct program control past block 376. The actual polishing process is carried out in control block 380.

The polishing head 150 is moved into position as shown in FIG. 4 and the desired polishing pressure is applied to the wafer surface. If rotation of the carrier support is required, control unit 88 energizes drive motor 80 to rotate the wafer support in the manner illustrated in FIG. 6. Further, during the polishing operation, it is preferred that monitoring probe 156 continuously, or at specified time intervals, feed data back to the control unit 88. This collected data can be used immediately to adjust the polish process. For example, it may be possible to determine whether polishing is proceeding at a rate which is greater or lesser than the desired or "target" polish rate. The polish pressure exerted by head 150 and/or the relative speed(s) of rotation can be adjusted "on the fly" such that the desired end point toward the work station will be achieved within the allotted time.

Polish progress is monitored in block 380 to determine if the desired end point has been reached (see block 382). If desired, the polishing operation can be controlled on a time basis as indicated in block 384. For example, overall system management may be provided in control unit 88 to ensure that the highest throughput rates possible are maintained for the overall system. Polishing at the various work stations must be completed or otherwise terminated in a controlled manner before the carrier ring 60 (see FIG. 2) is indexed to move the wafers to the downstream work station. Accordingly, it may be desirable to establish a preset time limit for each of the work stations, and to check progress at the work station against the time interval remaining.

In some instances, particularly where slurry from one work station should not be transferred to another work station, the polishing process must be terminated in advance of the allotted time interval, to allow the slurry to be flushed or rinsed from the wafer before the wafer is transferred by indexing. If sufficient time remains, as computed by control block 386, control is transferred via arrow 388 to control block 378 where the process is continued. If an end point condition is detected in block 382 prior to a time out of the permitted time period, control is transferred to block 390 to record the time results for the first work station position. Further polishing is then suspended in control block 392, in preparation for transfer of the wafer to the next work station by indexing of the carrier ring 60. If desired, a flushing of the slurry from the wafer can be performed as a condition precedent to indexing.

Referring again to control block 386, if a time-out condition is reached before polishing end point, control is transferred to block 396 where process results are recorded by control system 88, so that the process short fall can be made up at downstream work stations, if desired. Accordingly, an adjustment flag is set in control block 398 to indicate to a downstream work station that the desired results have not been obtained in preceding operations. The "adjust" flag can be used, for example, to trigger a program self-modification routine in which the operating program for the downstream work station is adjusted to make up the particular process short fall encountered. Control is then transferred to block 402 which ensures that all work stations have been set to the home position and that the polish heads are cleared from the wafer carriers. Control is then transferred as indicated by arrow 404 to further wafer processing control blocks needed to finish the wafer processing as desired.

Turning now to FIG. 11, detailed control steps as experienced by a particular semiconductor wafer are reviewed. In blocks 410–416 the system is powered on, the computer and control system of associated detectors is initialized, the apparatus is initialized and set to home positions and the process variables are entered, as described above. Next, the carrier ring is indexed under control of block 418 so as to deliver an empty carrier to the first, load position (see reference 31 in FIG. 2). The carrier at the load position is then raised so that (with reference to FIG. 6) the support pad 110 is raised above container ring 116. If desired, vacuum may be applied to the backing pad in order to secure the wafer in position as input transfer arm 22 delivers the wafer to the first carrier position, depositing the wafer on the support pad 110. The carrier is then lowered to attain the operating position illustrated, for example, in FIG. 7, thus completing the steps called for in control block 420.

In control block 422, control system 88 indexes the carrier ring to bring the wafer into position at the first work station (see reference numeral 32 in FIG. 2). If necessary, an operating program for the first work station is loaded and the processing apparatus is made ready for operation of the first work station. An adjustment flag from a proceeding operation is not expected to be detected in control block 424 and, accordingly, control is transferred past control block 426. If desired, an error in feeding the semiconductor wafer due to a malfunction of transfer arm 22, load robot 20 or input magazine 16, 18 may cause an adjust flag to be set and subsequently detected in control block 24, indicating absence of a wafer.

Ordinarily, control is transferred to block 428 where the treatment process is carried out on the wafer surface. For example, the polish head 150 is set in position as illustrated in FIG. 4, with the polish pad pressed against the wafer surface with a desired polish pressure. Slurry is conducted through conduit 64 and the polish pad and the polish head and carrier are rotated at the desired speeds. At control block 430 surface treatment progress is monitored by probe 156 and ongoing performance is compared against predefined data sets. If desired, the comparison step in block 430 can be arranged to identify and quantify any variance from target performance that is expected. If the variance is sufficiently great, programmed control can set an adjust flag so as to increase or decrease the programmed polishing rate in control block 426.

If the comparison in block 430 should indicate an end point condition has been attained, control is transferred to block 432 where the time for the first process step is recorded for future use. If for example, the end point condition is prematurely and consistently reached, the work station apparatus and particularly the associated sensors can be analyzed for possible faulty operation. Control is then transferred to block 434 which holds the wafer in preparation for carrier indexing. Control block 434 can initiate a wafer rinsing operation with water flowing through the polish head so as to prevent slurry from being transferred to a downstream location. The polish head would then be retracted to a home position and the wafer position held inactive in preparation for indexing of the carrier ring to be carried out in control block 436.

Returning to block 431, if an end point condition is not reached, the program timer for the work station is checked in control block 440 to determine if sufficient time remains to continue the processing operation as determined by control block 442, in which case control is transferred as indicted by arrow 444 to control block 428. Control block 442 may, for example, take into account the time required for rinsing the semiconductor wafer to prevent transfer of slurry to a downstream location. If a time-out condition is detected in control block 442, the process is prematurely stopped and the incomplete process results are recorded in block 446 and the adjust flag is set in block 448.

With the polishing head retracted to its home position, carrier ring 60 is then indeed under control of block 436 to the second work station position indicated, for example, by reference numeral 33 in FIG. 2. In control block 452 the second work station is prepared for a new processing operation. If necessary, the required individual modular program instructions are located and loaded. If an "adjust" flag is detected in control block 454, the program for the second work station is adjusted in control block 456, preferably in a manner which will make up for the processing shortfall in the preceding work station. Control is then transferred to block 458 where processing at the second work station is carried out. For example, if the second work station requires a slurry different from that of the first work station, the wafer will have preferably been rinsed at the upstream work station and made ready to receive the new slurry.

The polishing head is positioned and the slurry is fed in the manner indicated in FIG. 4. The process parameters (e.g., performance indicators) are then reviewed in control block 460 and an end point condition is checked in block 462. If desired, control block 460 can be used to set an adjust flag and performance data is stored for use when control is transferred to block 456. If the end point condition is detected, control is transferred to block 464 where the time results are recorded and the wafer is then held in an idle position in control block 466. If the end point condition is not reached, the remaining time is evaluated in the control block 470 and a time out condition is checked in control block 472. If sufficient time remains, control is transferred back to block 458, as indicated by arrow 474. If control block 460 is used to set an adjust flag in preparation for program adjustment, arrow 474 can be rerouted to transfer control to control block 454.

If a time out condition is detected in control block 472, further processing is halted and the results obtained thus far are recorded in control block 478. An indication of the processing short fall is given by setting the adjustment flag in control block 480 and control is transferred to block 482 with the carrier ring 60 being indexed to bring the wafer to the next work station position (i.e., work station number 3 located above position 34 in FIG. 2).

Control is then continued at successive downstream work stations, with the control steps at each work station being substantially the same as that described above for control blocks 452 through 482. In the preferred embodiment, six carrier positions are provided in the carrier table and of these two positions are used for loading and unloading. Further, in the preferred embodiment the fourth work station, located opposite position 35 in FIG. 2, is dedicated to a final cleaning of the semiconductor wafer in preparation for a final indexing to position 36 and then unloading of the wafer for storage in magazines 46, 48.

In the preferred embodiment, control is transferred from block 482 directly to block 492 where initialization of the third work station, opposite position 34 in FIG. 2, is carried out by control block 492. If an adjust flag is detected in block 494, control is transferred to block 496 which modifies the program for the final work station (herein assumed to be work station number 3, located opposite position 34 in FIG. 2). The process is then carried out in control block 498 with a desired polish pressure, relative rotational speeds and slurry feed being provided, as described above.

Performance progress is monitored by probe 156 and is reviewed in control block 502. If an end point condition is detected in block 504, control is transferred to block 506 where the process time is stored for future analysis. Control is then transferred to block 508 which makes ready the carrier and wafer for indexing to the final rinse position. At block 508, rinse water may be directed through the polishing head to flush most of the slurry from the wafer surface, and, if desired, the polish head can thereafter be removed and the wafer accelerated to a "spin dry" speed. Thereafter, the wafer is held in an inactive state awaiting final indexing, under control of block 510.

If an end point condition is not detected in block 504, the remaining time is evaluated in block 514 and a time out condition is tested in block 516. If sufficient time remains, control is transferred to block 498 as indicated by arrow 520. If the comparison process in block 502 is used to indicated that an adjustment to further programmed processing is necessary, arrow 520 can be rerouted to control block 494.

If a time-out condition is detected in block 516, control is transferred to block 524 where the process results are recorded for future use, and an adjustment flag is set in control block 526. In a preferred embodiment, where the control block 526 is associated with evaluation of the process attained at the final polishing work station 34, control block 526 can send an error message to the operator inquiring if the operator wishes to override programmed control so as to assure that a satisfactory final wafer condition has been achieved. It may be desirable, in certain instances, to indicate in control block 526 that the final results attained may be unsatisfactory and to "tag" this result with the final wafer storage position in magazines 46, 48.

Control is then transferred to block 510 which indexes the wafer to the final work station which, as mentioned, comprises a final cleaning station in the preferred embodiment. Control is then transferred to block 512 which controls the final cleaning of the wafer at position 35 (see FIG. 2), and thereafter awaits a subsequent indexing of carrier ring 60 to bring the wafer to the unload position 36 in FIG. 2. Thereafter, transfer arm 40, under control of block 512, removes the wafer from the carrier position with scrubber robot 44 thereafter storing the wafer in either magazine 46 or 48.

The present invention contemplates an overall simultaneous control of all of the work stations, with indexing being carried out at controlled times. For example, the final indexing for the wafer tracked in FIG. 11 between positions 35 and 36 in FIG. 2 would be carried out only when a master control overview of the process at work stations 32–34 indicates that those work stations are also ready for an index to occur. In this instance, the "index table" signals of the various control blocks described above may be considered as a "permissive" signal, with actual indexing commands being carried out when so-called "permissive" signals are received from each of the work stations involved.

As can be seen from the above, the present invention makes possible an effective division of labor for each wafer, to be spread across multiple work stations. The description above has assumed that maximum throughput of the overall system is the controlling operational interest. However, other operational modes may be desired, such as the complete attainment of a desired partial processing step at a particular work station, regardless of the amount of time required. In this instance, there will be little or no regard for disparate processing times which may be required at the various work stations.

Further variations are also possible. For example, when different wafer curvatures are desired, polish pads of differing curvatures and/or polishing heads of different curvatures would be employed. However, it is also possible to provide wafer pad 110 or wafer supports 108 (as shown, for example, in FIG. 6) as having the desired, differing curvatures. If desired, the support pads 110 and wafer carriers 108 can be made to be readily removable from the carrier table and a variety of components having different curvatures can be stored at the operational location. If such measures are employed, it may be necessary to keep track of the position of each individual wafer carrier and such can be easily attained using conventional equipment during the initialization and indexing steps mentioned above.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An arrangement for polishing a surface of a semiconductor wafer, comprising:

a carrier table rotatable about a central axis, the carrier table defining a plurality of wafer-receiving positions each having an upper, support surface for supporting the semiconductor wafer;

a plurality of polishing positions, each including a polish pad carried by a polishing head which is movable toward and away from said carrier table, into and out of pressing engagement with semiconductor wafers carried on said carrier table;

index and control means for indexing said carrier table so that a semiconductor wafer is moved from one polishing position to another and for controlling said polishing heads and said index table so that a semiconductor wafer carried on said carrier table is polished by a plurality of said polishing heads positions, in succession.

2. The arrangement of claim 1 further comprising load means for loading wafers to be polished onto said carrier table.

3. The arrangement of claim 2 further comprising unload means for unloading wafers from said carrier table.

4. The arrangement of claim 3 wherein said load means and said unload means are operated so as to move said wafers between upper and lower positions.

5. The arrangement of claim 4 wherein said load means and said unload means include means for raising the upper support surface above the carrier table.

6. The arrangement of claim 1 further comprising polish drive means for driving at least one of said polish head and said support surface to establish a polishing motion between the polish pad carried on said polish head and the semiconductor wafer surface.

7. The arrangement of claim 1 wherein said polishing positions include a support arm for pressing the polish pad against the semiconductor wafer surface.

8. The arrangement of claim 7 further comprising drive means for rotationally driving the polish head and hence the polish pad with respect to the semiconductor wafer surface.

9. The arrangement of claim 8 wherein said semiconductor wafer surface has a predetermined size and said polish pad has a smaller size.

10. The arrangement of claim 9 further comprising oscillating means for moving the polish head and thus the polishing pad back and forth across said semiconductor wafer surface.

11. The arrangement of claim 5 wherein said polishing positions, said load means and said unload means are spaced about a common circular path.

12. The arrangement of claim 11 wherein said plurality of support surfaces are spaced about the common circular path.

13. The arrangement of claim 1 wherein said polishing stations are independently operated, one from another.

14. The arrangement of claim 1 wherein said at least one of said polishing heads and said polishing pads have differing contour surfaces.

15. The arrangement of claim 1 further comprising slurry supply means for supplying a polishing slurry to said plurality of polishing positions.

16. The arrangement of claim 15 wherein said polishing slurries differ one from another.

17. The arrangement of claim 16 wherein said polishing slurries have different pH values.

18. The arrangement of claim 1 wherein said polishing heads apply differing polishing pressures.

19. The arrangement of claim 18 wherein said polishing heads are operated at differing speeds.

20. The arrangement of claim 1 further comprising monitoring probes associated with said polishing positions to monitor the semiconductor wafer surface being processed.

21. The arrangement of claim 20 wherein said monitoring probes are coupled to said control means with data from the monitoring probe of one polishing station being employed to alter control of the polishing head at a downstream station receiving said predetermined semiconductor wafer upon indexing of said carrier table.

22. The arrangement of claim 15 further including cleaning water flow means for directing a flow of cleaning water to said slurry supply means subsequent to a polishing operation at a polishing position.

23. An arrangement for polishing a surface of a semiconductor wafer, comprising:

a carrier table rotatable about a central axis, the carrier table defining a plurality of wafer-receiving positions each having an upper, support surface for supporting the semiconductor wafer;

a plurality of polishing positions aligned with said carrier table so as to be located adjacent respective ones of said carrier table positions, each polishing position including a polish pad carried by a polishing head which is movable toward and away from said carrier table, into and out of pressing engagement with semiconductor wafers carried on said carrier table; and index means for indexing said carrier table so as to move a semiconductor wafer from one polishing position to another, so that a semiconductor wafer carried on said carrier table is polished by a plurality of said polishing positions, in succession.

24. The arrangement of claim 23 wherein said means for loading and unloading wafers comprises a load means adjacent one carrier table position and an unload means for unloading wafers adjacent a second carrier table position.

25. The arrangement of claim 23 further comprising means adjacent at least one of the carrier table positions for loading and unloading wafers to and from said carrier table wherein said load means and said unload means are operated substantially simultaneously to move said wafers between upper and lower positions.

26. The arrangement of claim 23 wherein said polishing positions include a support arm for pressing the polish pad against the semiconductor wafer surface.

27. The arrangement of claim 26 further comprising oscillating means for moving the polish head and thus the polishing pad back and forth across said semiconductor wafer surface.

28. The arrangement of claim 23 further comprising monitoring probes associated with said polishing positions to monitor the semiconductor wafer surface being processed.

* * * * *